US010256542B2

(12) United States Patent
Hong et al.

(10) Patent No.: US 10,256,542 B2
(45) Date of Patent: Apr. 9, 2019

(54) CHIP ANTENNA AND METHOD OF MANUFACTURING THE SAME

(71) Applicant: SAMSUNG ELECTRO-MECHANICS CO., LTD., Suwon-si (KR)

(72) Inventors: Ha Ryong Hong, Suwon-si (KR); Sung Jun Park, Suwon-si (KR); Dae Kyu Lee, Suwon-si (KR); Sung Eun Cho, Suwon-si (KR); Ju Hyoung Park, Suwon-si (KR); Seung Hun Ryu, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 6 days.

(21) Appl. No.: 15/157,093

(22) Filed: May 17, 2016

(65) Prior Publication Data

US 2016/0372830 A1 Dec. 22, 2016

(30) Foreign Application Priority Data

Jun. 18, 2015 (KR) ..... 10-2015-0086536
Nov. 3, 2015 (KR) ..... 10-2015-0153721

(51) Int. Cl.
*H01Q 1/22* (2006.01)
*H01Q 1/40* (2006.01)
*H01Q 7/08* (2006.01)

(52) U.S. Cl.
CPC ..... *H01Q 7/08* (2013.01); *H01Q 1/2283* (2013.01); *H01Q 1/40* (2013.01)

(58) Field of Classification Search
CPC .... H01Q 7/08; H01Q 1/2283; H01F 27/2828; H01F 27/29; H01F 27/292;
(Continued)

(56) References Cited

U.S. PATENT DOCUMENTS

2005/0007281 A1 1/2005 Furuya
2006/0152427 A1* 7/2006 Ueda ..... H01Q 7/08 343/788

(Continued)

FOREIGN PATENT DOCUMENTS

CN 202384498 U 8/2012
CN 105024170 A 11/2015

(Continued)

OTHER PUBLICATIONS

Korean Office Action dated Jul. 29, 2016 in counterpart Korean Application No. 10-2015-0153721 (pp. 1-4 in English; pp. 5-8 in Korean).

(Continued)

*Primary Examiner* — Robert Karacsony
(74) *Attorney, Agent, or Firm* — NSIP Law

(57) ABSTRACT

A chip antenna and a method of manufacturing the same are provided. A chip antenna includes connection terminals disposed on both ends of a core, and a coil wound around the core and having ends thereof connected to the connection terminals, in which the connection terminals include a metal plate, and at least a portion of the connection terminals has a thickness greater than a winding thickness of the coil.

15 Claims, 6 Drawing Sheets

(58) Field of Classification Search
CPC .. H01F 2007/062; H01F 41/076; H01F 41/10; H01F 5/04; H01F 2005/043; H01F 2005/046
See application file for complete search history.

(56) References Cited

U.S. PATENT DOCUMENTS

| | | | |
|---|---|---|---|
| 2009/0284423 | A1 | 11/2009 | Yi et al. |
| 2015/0295315 | A1 | 10/2015 | Tanaka et al. |

FOREIGN PATENT DOCUMENTS

| | | | |
|---|---|---|---|
| JP | 2522229 | Y2 | 10/1996 |
| JP | 2013-84652 | A | 5/2013 |
| KR | 10-2005-0008466 | A | 1/2005 |
| KR | 10-2009-0118764 | A | 11/2009 |

OTHER PUBLICATIONS

Chinese Office Action dated Nov. 27, 2018 in corresponding Chinese Patent Application No. 201610397733.2 (16 pages in English and 11 pages in English).

* cited by examiner

CHIP ANTENNA AND METHOD OF MANUFACTURING THE SAME

CROSS-REFERENCE TO RELATED APPLICATION(S)

This application claims the benefit under 35 USC 119(a) of Korean Patent Application No. 10-2015-0086536 filed on Jun. 18, 2015 and Korean Patent Application No. 10-2015-0153721, filed on Nov. 3, 2015, in the Korean Intellectual Property Office, the entire disclosure of which is incorporated herein by reference for all purposes.

BACKGROUND

1. Field

The following description relates to a chip antenna and a method of manufacturing the same.

2. Description of Related Art

Mobile communications terminals that support wireless communications, such as mobile phones, personal digital assistants (PDAs), navigation devices, laptop computers, and the like, have the capability to provide functions such as code division multiple access (CDMA), digital multimedia broadcasting (DMB), a wireless local area network (WLAN), near field communications (NFC), and the like. The capability for wireless communications may be provided by an antenna disposed in the mobile communications terminals.

Among various types of antenna, a chip antenna is generally directly mounted on a surface of a circuit board to perform its function.

A chip antenna is also appropriate for miniaturization and slimness, and may be manufactured by stacking patterns in a ceramic material.

However, when a chip antenna is manufactured to be of a solenoid type, it is difficult to secure a space in which a coil is wound.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna includes connection terminals disposed on both ends of a core, and a coil wound around the core and having ends thereof connected to the connection terminals, in which the connection terminals include a metal plate, and at least a portion of the connection terminals has a thickness greater than a winding thickness of the coil.

The connection terminals may include a sleeve shape enclosing the core.

The connection terminals may include a disconnected ring shape.

End portions of the connection terminals may be disposed to face each other.

End portions of the connection terminals may be respectively disposed on different surfaces of the core.

The connection terminals may include an upper surface part contacting an upper surface of the core, a lower surface part contacting a lower surface of the core, and a connection part extending between the upper surface part and the lower surface part.

The connection parts of the connection terminals may be each disposed to cover a distal end of the core.

The connection terminals may include metal plates that are elastically deformed and coupled to the core.

The general aspect of the chip antenna may further include a protection resin disposed on at least one surface of the core where the coil is wound around.

In another general aspect, a method of manufacturing a chip antenna involves preparing a core having a bar shape; coupling connection terminals to both ends of the core, respectively, the connection terminals each being formed by bending a metal plate; and winding a coil around the core and connecting both ends of the coil to the connection terminals.

The coupling of the connection terminals may involve press-fitting both ends of the core into the respective connection terminals.

A thickness of a portion of the connection terminal disposed below the core may be greater than a winding thickness of the coil.

The general aspect of the method may further involve forming a protection resin on at least one surface of the core where the coil is wound around.

In another general aspect, a method of manufacturing a chip antenna involves coupling a bent conductive plate to a core to form a connection terminal, and electrically connecting a coil wound around the core with the connection terminal to establish an electrical connection.

The coil may be wound in a helical shape around the core, and two connection terminals may be disposed on two respective areas of the core to be electrically connected with respective end portions of the coil.

The coupling of the bent conductive plate may involve press-fitting a distal end of the core into a bent metal plate to form the connection terminal.

The general aspect of the method may further involve mounting the core on which the connection terminal is formed on a board, in which a thickness of a portion of the connection terminal disposed between the core and the board may be greater than a winding thickness of the coil.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
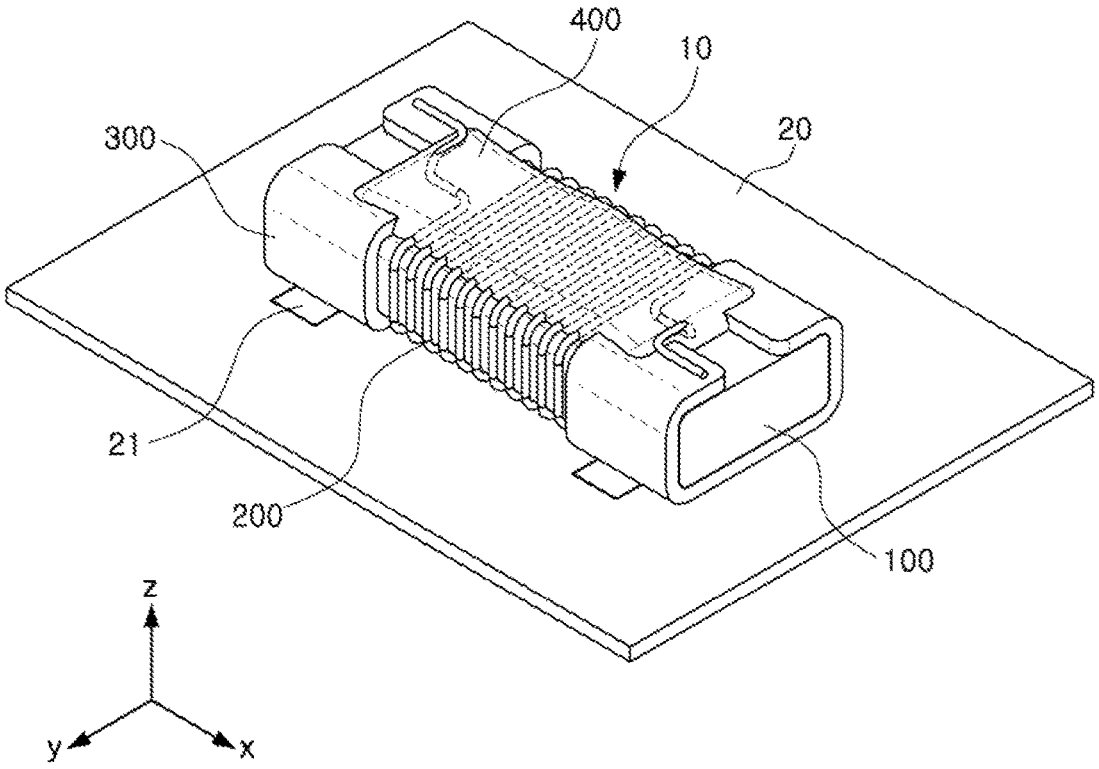
FIG. 1 is a perspective view illustrating an example of a chip antenna according to the present disclosure.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. The sequences of operations described herein are merely examples, and are not limited to those set forth herein, but may be changed as will be apparent to one of ordinary skill in the art, with the exception of operations necessarily occurring in a certain order. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Throughout the specification, it is to be understood that when an element, such as a layer, region or substrate, is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, other elements or layers intervening therebetween cannot be present. Like numerals refer to like elements throughout. As used herein, the term "and/or" includes any and all combinations of one or more of the associated listed items.

Although terms such as "first," "second," and "third," may be used herein to describe various members, components, regions, layers and/or sections, these members, components, regions, layers, or sections are not to be limited by these terms. These terms are only used to distinguish one member, component, region, layer or section from another member, component, region, layer or section. Thus, a first member, component, region, layer or section discussed in examples below may also be referred to as a second member, component, region, layer or section without departing from the teachings of the examples.

Spatially relative terms, such as "above," "upper," "below," and "lower" may be used herein for ease of description to describe one element's relationship to one or more other elements as shown in the figures. It is to be understood that the spatially relative terms are intended to encompass different orientations of the device in use or operation in addition to the orientation depicted in the figures. For example, if the device in the figures is turned over, elements described as being "above" another element or being an "upper" element will then be "below" the other element or will be a "lower" element. Thus, the term "above" can encompass both the above and below orientations depending on a particular direction of the figures. The device may also be oriented in other ways (for example, rotated 90 degrees or at other orientations) and the spatially relative descriptors used herein are to be interpreted accordingly.

The terminology used herein describes various examples only and is not to be used to limit the present disclosure. As used herein, the singular terms "a," "an," and "the" are intended to include the plural forms as well, unless the context clearly indicates otherwise. Further, as used herein, the terms "include," "comprises," and "have" specify the presence of stated features, numbers, operations, members, elements, and/or combinations thereof, but do not preclude the presence or addition of one or more other features, operations, members, elements, and/or combinations thereof.

Hereinafter, examples will be described with reference to schematic diagrams. In the drawings, due to manufacturing techniques and/or tolerances, for example, modifications of the shape shown may be estimated. Thus, this examples described herein are not to be construed as being limited to the particular shapes of regions shown herein, but are to be construed as including changes in shape that occur during manufacturing. The features of the examples described herein may be combined in various ways as will be apparent to one of ordinary skill in the art. Further, although the examples described below have a variety of configurations, other configurations are possible as will be apparent to one of ordinary skill in the art.

Figure 2:
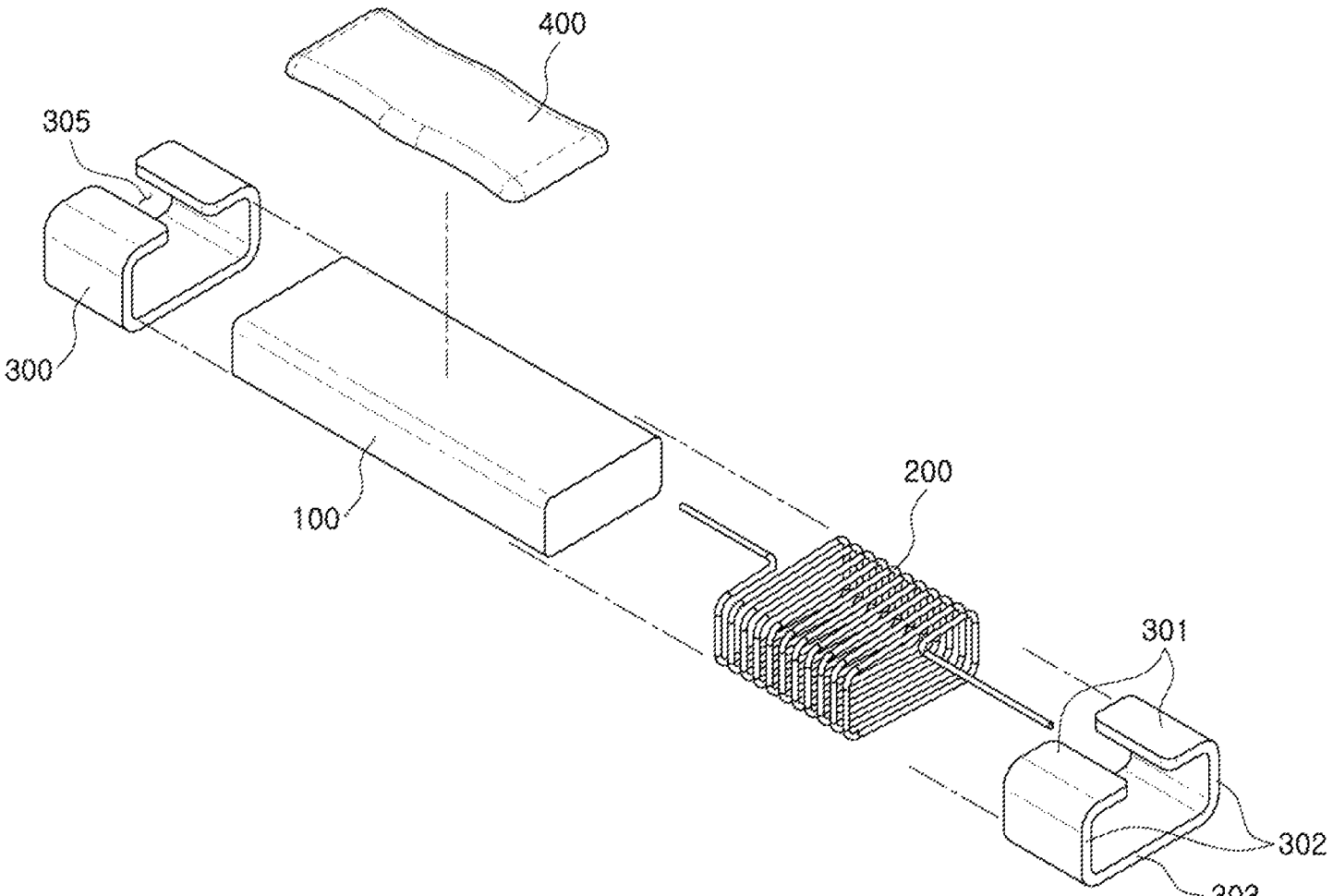
FIG. 2 is an exploded perspective view illustrating an example of a chip antenna according to the present disclosure.
Figure 3:
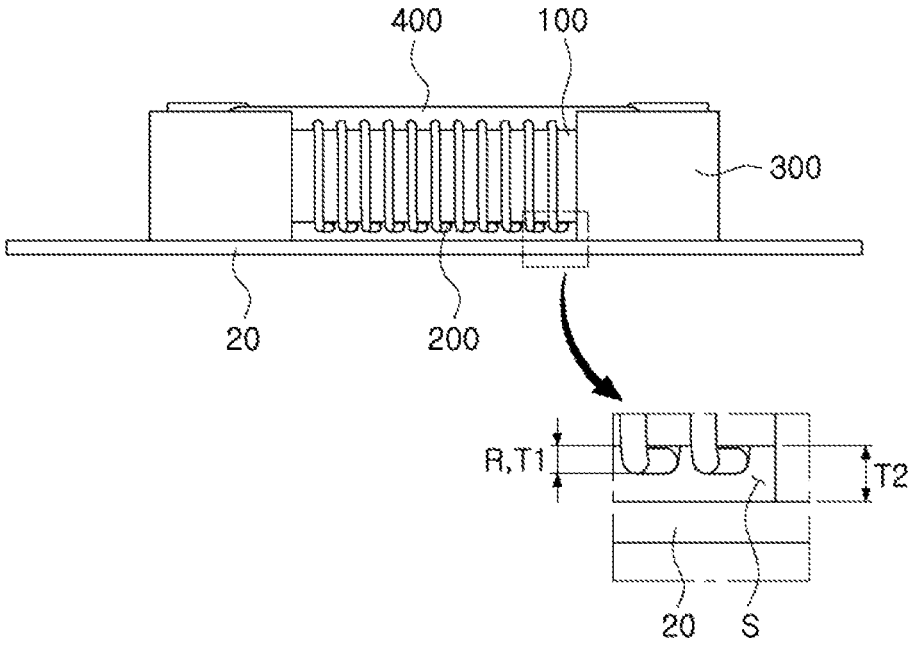
FIG. 3 is a side view illustrating an example of a chip antenna according to the present disclosure.

FIG. 1 illustrates a perspective view of an example of a chip antenna according to the present disclosure, and FIG. 2 illustrates an exploded perspective view of an example of a chip antenna according to FIG. 1. FIG. 3 illustrates a side view of an example of a chip antenna according to FIG. 1.

According to one example, a solenoid winding space may be secured in a chip antenna in an efficient manner during a manufacturing process of producing a chip antenna.

Referring to FIGS. 1 through 3, an example of a chip antenna 10 according to the present disclosure includes a core 100, a coil 200, and connection terminals 300.

The core 100 may be formed of ferrite or a ferrite mixture. In one example, the core 100 may be formed by sintering ferrite powders, or may be formed by injection-molding a resin mixture containing ferrite powders.

In addition, the core 100 may be prepared by stacking a plurality of ceramic sheets containing ferrite as a main component and then compressing/sintering the plurality of ceramic sheets.

In this example, the core 100 has a bar shape with a quadrangular cross section, but the shape of the core 100 is not limited thereto. That is, in another example, the core 100 may another shape, depending on a design requirement or structural requirement of the chip antenna.

The coil 200 is wound around the core 100. For example, the coil 200 may be wound in a helical shape along a length direction of the core 100. However, a shape in which the coil is wound is not limited thereto.

In addition, the coil 200 is connected to the connection terminals 300 disposed at both ends of the core 100. For example, both ends of the coil 200 may be bonded to the connection terminals 300, respectively, through soldering.

Herein, various terms indicating directions will be defined. A length direction of the core 100 refers to an x-axis direction in FIG. 1, a width direction of the core 100 refers to a y-axis direction in FIG. 1, and a thickness direction of the core 100 refers to a z-axis direction in FIG. 1.

Referring to FIG. 1, the coil 200 has a wire shape, and is wound around the core 100. However, a shape of the coil 200 is not limited thereto, and may be an edgewise coil shape in another example.

In this example, both end portions of the coil 200 are bonded to the connection terminals 300. Both end portions of the coil 200 are further disposed on the same surface of the core 100. However, the configuration of the end portions of the coil 200 is not limited thereto. In another example, the end portions of the coil 200 may be disposed on different surfaces.

In addition, an example in which the end portions of the coil 200 are disposed on an upper surface of the core 100 has been described by way of example in FIG. 1. However, in another example, various modifications may be made. For instance, in one example, the end portions of the coil 200 may be disposed on a lower surface of the core 100.

Referring to FIG. 1, the connection terminals 300 for electrical connection to a main board 20 are coupled to both end portions of the core 100, respectively.

The connection terminal 300 may serve as a terminal bonded to the main board 20 through a conductive adhesive such as a solder. Therefore, a lower surface of the connection terminal 300 may be used as a bonded surface bonded to the main board 20.

The connection terminals 300 may be formed by bending a flat conductive plate such as a metal plate or performing press processing, and may be coupled to the core 100 to enclose the core 100 at two opposing ends of the core 100.

Referring to the example illustrated in FIG. 2, the connection terminal 300 includes an upper surface part 301 coupled to the upper surface of the core 100 while contacting the upper surface of the core 100, a lower surface part 303 coupled to the lower surface of the core 100 while contacting the lower surface of the core 100, and a connection part 302 connecting the upper surface part 301 and the lower surface part 303 to each other.

The connection terminal 300 may be formed in a sleeve shape or a disconnected ring shape accommodating the core 100 therein. Further, according to one example, a cut part 305 cutting through the connection terminal 300 may be formed in the upper surface part 301 of the connection terminal 300, as illustrated in FIG. 2.

Referring to the example illustrated in FIG. 2, both ends of the connection terminal 300 are disposed to be spaced apart from each other by the cut part 305 by a predetermined distance. To form a chip antenna in which both ends of the connection terminal 300 are spaced apart from each other, according to one example of a method of manufacturing the same, a metal plate or the like may be elastically deformed and firmly coupled to the core 100 by elastic force depending on the elastic deformation to form the connection terminal 300.

However, a configuration of the connection terminal 300 is not limited thereto, and may be variously modified. For example, FIG. 4C illustrates an embodiment in which the connection terminal 300 is formed in a sleeve shape without including the cut part 305.

In addition, according to one example, a thickness of a portion or an entirety of the connection terminal 300 may be set to be thicker than a winding thickness of the coil 200.

Referring to the example illustrated in FIG. 3, the coil 200 has a predetermined diameter R which is smaller than a distance between the core 100 and the bonded surface of the connection terminal 300. For instance, for a single layer coil, the diameter of a wire that forms the coil may have the predetermined diameter R. If the distance between the core 100 and the bonded surface of the connection terminal 300 was set be smaller than the diameter R of the coil 200, the coil 200 and the main board 20 would contact each other when the chip antenna 10 is mounted on the main board 20, deteriorating the performance of the chip antenna 10.

Therefore, in the chip antenna 10 according to the illustrated embodiment, a thickness T2 of the connection terminals 300 disposed at both ends of the core 100 is set to be thicker than a winding thickness T1 of the coil 200.

The winding thickness T1 of the coil 200 refers to a maximum distance between a surface of the coil 200 disposed at the outermost portion and the core 100. In this example, the coil 200 is wound around the core 100 as a single layer. Therefore, the diameter R of the coil 200 is equal to the winding thickness T1 of the coil 200. However, in another example, two or more layers may be wound around the core 100.

Meanwhile, in this example, the connection terminal 300 has the same thickness around all directions of the core 100. Therefore, all of the connection part 302 and the upper surface part 301 as well as the lower surface part 303 may be formed at a thickness of T2. However, the thicknesses of the connection part 302 and the upper surface part 301 are not limited thereto. That is, the connection part 302 and the upper surface part 301 are not limited to the illustrated thicknesses or shapes as long as the thickness of the lower surface part 303 may be thicker than the winding thickness T1 of the coil 200.

Due to the configuration described above, a space S is provided in the chip antenna 10, and the coil 200 passes through the space S. A height of the space S in the thickness direction is greater than the winding thickness T1 of the coil 200 due to the thickness T2 of the connection terminal 300, and thus, the coil 200 wound around the core 100 does not contact the main board 20.

A protection resin 400 may be disposed on the core 100 to insulate and protect the coil 200. In this example, the protection resin 400 is disposed on the core 100 so as to cover the coil 200.

However, in another example, the protection resin 400 may be applied on all surfaces of the core 100. In the illustrated example, the protection resin 400 is applied on only one surface of the core 100. That is, the protection resin 400 is applied on the upper surface of the core 100. In this example, the upper surface of the core 100 corresponds to the surface of the core 100 that is disposed on an opposite side from the main board 20 when the chip antenna 10 is mounted on the main board 20.

The protection resin 400 may be formed by applying a liquid-phase resin and then hardening the liquid-phase resin. As a material of the protection resin 400, a resin such as epoxy or a mixture of ferrite powders having a magnetic property and a resin may be used. However, a material of the protection resin 400 is not limited thereto.

Hereinafter, modified examples of the connection terminal 300 will be described.

Figure 4A:
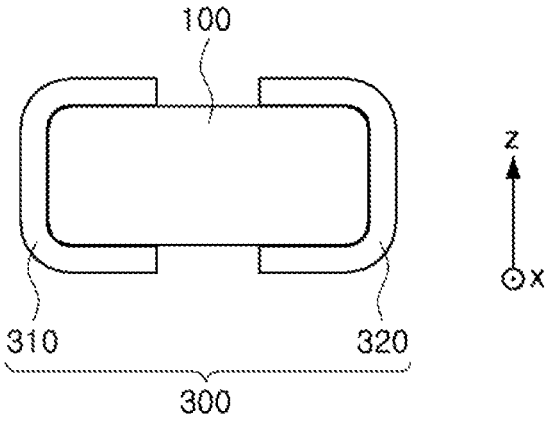
FIGS. 4A through 4C are side views illustrating additional examples of a chip antenna according to the present disclosure.
Figure 4B:
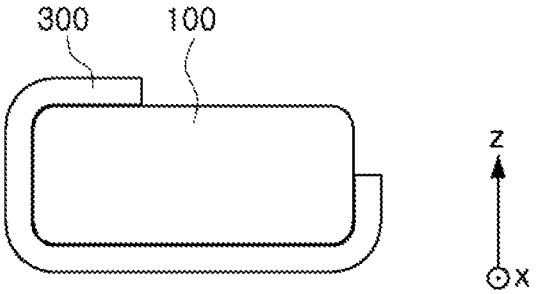
Figure 4C:
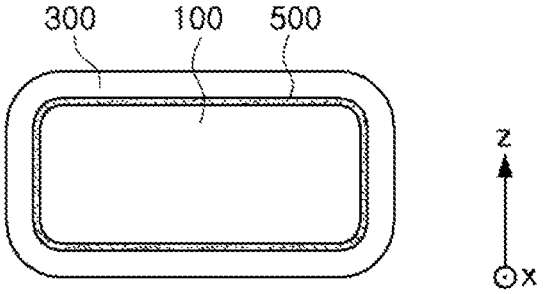

FIGS. 4A through 4C are schematic side views illustrating modified examples of the connection terminal 300 according to the present disclosure.

Referring to FIG. 4A, in one example, at least one of the connection terminals 300 may be provided as two members spaced apart from each other.

The connection terminal 300 according to FIG. 4A includes a first connection terminal 310 and a second connection terminal 320.

In this example, the first connection terminal 310 and the second connection terminal 320 partially enclose an outer peripheral surface of the core 100, and end portions of the first connection terminal 310 and the second connection terminal 320 are disposed to face each other.

Referring to FIG. 4B, the two end portions of the connection terminal 300 are disposed on different surfaces of the core 100, respectively.

In this example, one end portion of the connection terminal 300 is disposed on the upper surface of the core 100, and the other end portion thereof is disposed on a side surface of the core 100.

Referring to FIG. 4C, the connection terminal 300 is formed in a sleeve shape that does not have a cut part. In this case, an adhesion member 500 is interposed between the connection terminal 300 and the core 100 in order to firmly couple the connection terminal 300 to the core 100.

However, a method of firmly coupling the connection terminal 300 to the core 100 is not limited thereto, and may be variously modified. For example, the connection terminal 300 may be firmly coupled to the core 100 by disposing the core 100 in the connection terminal 300 and then pressing/bending the connection terminal 300.

Meanwhile, respective embodiments illustrated in FIGS. 4A through 4C may be combined with each other.

Next, an example of a method of manufacturing a chip antenna will be described.

FIGS. 5A through 5D are perspective views illustrating states of respective operations of an example of a method of manufacturing a chip antenna according to the present disclosure.

Figure 5B:
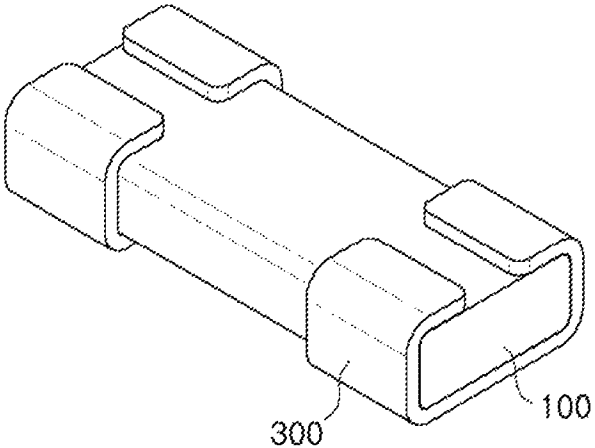
FIGS. 5A through 5D are views illustrating an example of a method of manufacturing a chip antenna according to the present disclosure.
Figure 5D:
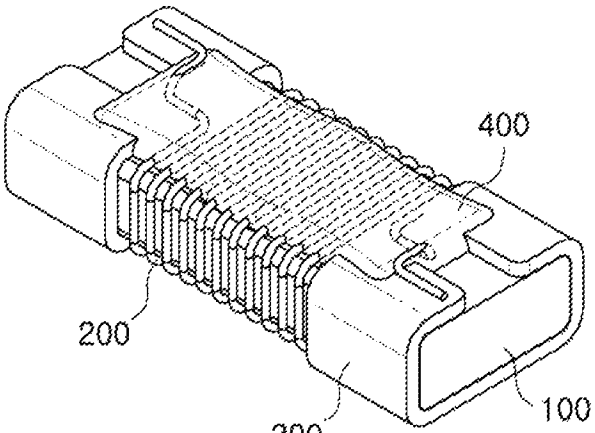
Figure 5A:
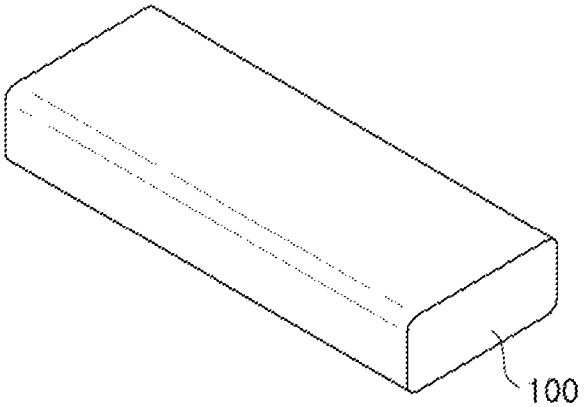

First, the core 100 is prepared (see FIG. 5A). As described above, the core 100 may be formed by sintering ferrite, or may be formed of a ferrite mixture. In addition, the core 100 may be prepared by stacking a plurality of ceramic sheets containing ferrite as a main component.

Then, the connection terminals 300 are coupled to both ends of the core 100 in the length direction (see FIG. 5B).

The connection terminals 300 may be separately manufactured and coupled to the core. For example, the connection terminal 300 may be formed by press-working or bending a flat conductive plate such as a metal plate.

In this example, the connection terminals 300 are coupled to the core 100 to enclose the core 100 at both ends of the core 100.

The connection terminals 300 may be coupled to the core 100 in a state in which the connection terminals 300 are elastically deformed by further increasing an interval of the cut part 305. Therefore, the connection terminals 300 may be firmly coupled to the core 100 by elastic force.

However, a method of coupling the connection terminals 300 to the core 100 is not limited thereto, and may be modified into various methods well-known in the related art, such as a bonding method by an adhesive, a press-fitting method, and the like.

Figure 5C:
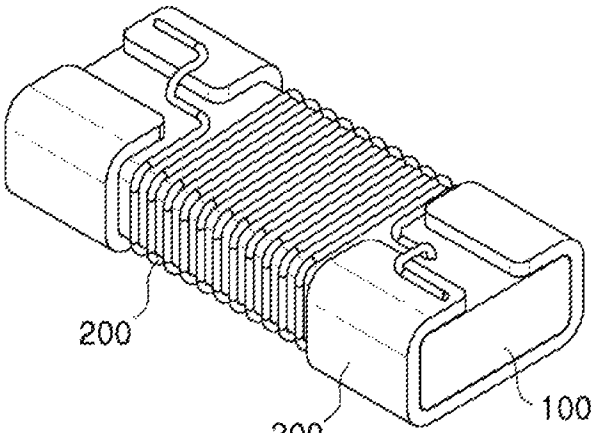

After the connection terminals 300 are coupled to the core 100, the coil 200 is wound around the outer peripheral surface of the core 100 (see FIG. 5C).

In this example, the coil 200 has a helical shape that goes around the outer peripheral surface of the core 100. In addition, both ends of the coil 200 are bonded and electrically connected to the connection terminals 300 disposed at both ends of the core 100. According to one example, the coil 200 may be bonded to the connection terminals 300 by soldering.

In the connection terminal 300 according to FIG. 5C, a portion of the connection terminal 300 disposed below the core 100 has a greater thickness than the winding thickness T1 (see FIG. 3) of the coil 200 that wraps around the core 100. Therefore, the lower surface of the connection terminal 300 (for example, the bonded surface bonded to the main board) is disposed at a position lower than that of a lower surface formed by the coil 200.

Then, the protection resin 400 is formed on an outer surface of the core 100 (see FIG. 5D). The protection resin 400 may be disposed to cover at least a portion of the coil 200.

In this example, the protection resin 400 is disposed on at least one surface of the core 100 where the coil 200 is wound around. The protection resin 400 may be formed by applying and then hardening a liquid-phase resin. An epoxy resin may be used as the resin for forming the protection resin 400.

However, the protection resin 400 is not limited thereto. For example, the protection resin 400 may also be formed of an epoxy resin containing ferrite powders. In addition, various other modifications may be made. For instance, in yet another example, the protection resin may be formed using a sheet in a semi-hardened state and may then be attached onto the core 100, or a completely hardened protection resin may be adhered to the core 100 using the adhesion member 500.

In the chip antenna according to the present embodiment, the connection terminals 300 may be separately manufactured and then be coupled to the core 100. Therefore, the connection terminals are more easily manufactured as compared to the related art in which the connection terminals 300 are directly formed on the core 100. This will be described in detail below.

In a case of the related art, the connection terminals 300 may be formed by partially plating end portions of the core 100. In this case, bonded surfaces of the connection terminals 300 need to be disposed at a position lower than that of the lower surface of the coil 200. To this end, electrode terminals may be formed by attaching separate members having a predetermined thickness to both ends of the core 100 and then performing plating on surfaces of the separate members. Therefore, a manufacturing process of the connection terminals 300 may be very complicated.

On the other hand, in the chip illustrated in FIGS. 5A to 5D, the formation of the connection terminals 300 is completed only by coupling the connection terminals 300 to the core 100 without partially plating the end portions of the core 100. Therefore, a complicated process such as plating may not additionally be required, and a thickness of the connection terminal 300 itself may be thicker than the winding thickness. Thus, the separate member described above is not required. Therefore, it may be appreciated that the connection terminal is very easily manufactured.

Meanwhile, the present disclosure is not limited to the above-mentioned embodiments, and may be variously modified.

Chip antennas disclosed below may be similar to the chip antenna according to the examples described above except for a structure of a connection terminal. Therefore, a detailed description will be omitted for the same or similar features as that described above, and only a connection terminal that is different from that of the examples above will be described in detail.

Figure 6:
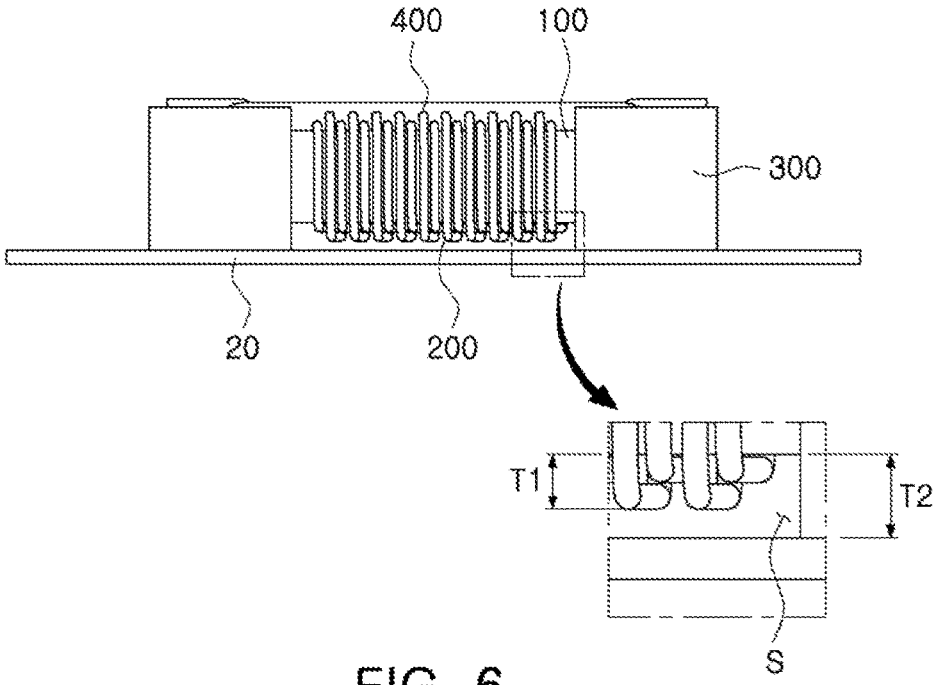
FIG. 6 is a side view schematically illustrating another example of a chip antenna according to the present disclosure.

FIG. 6 is a side view schematically illustrating another example of a chip antenna according to the present disclosure.

Referring to FIG. 6, a coil 200 is wound in a plurality of layers around the core 100. Therefore, a winding thickness T1 of the coil 200, which corresponds to the total thickness of the wires on a surface of the core 100, may be larger than a diameter of a wire of the coil 200.

The connection terminal 300 according to the illustrated example has a thickness T2 that is greater than the winding thickness T1 of the coil 200.

As described above, the connection terminal 300 may have various thicknesses depending on a winding configuration of the coil 200.

Figure 7:
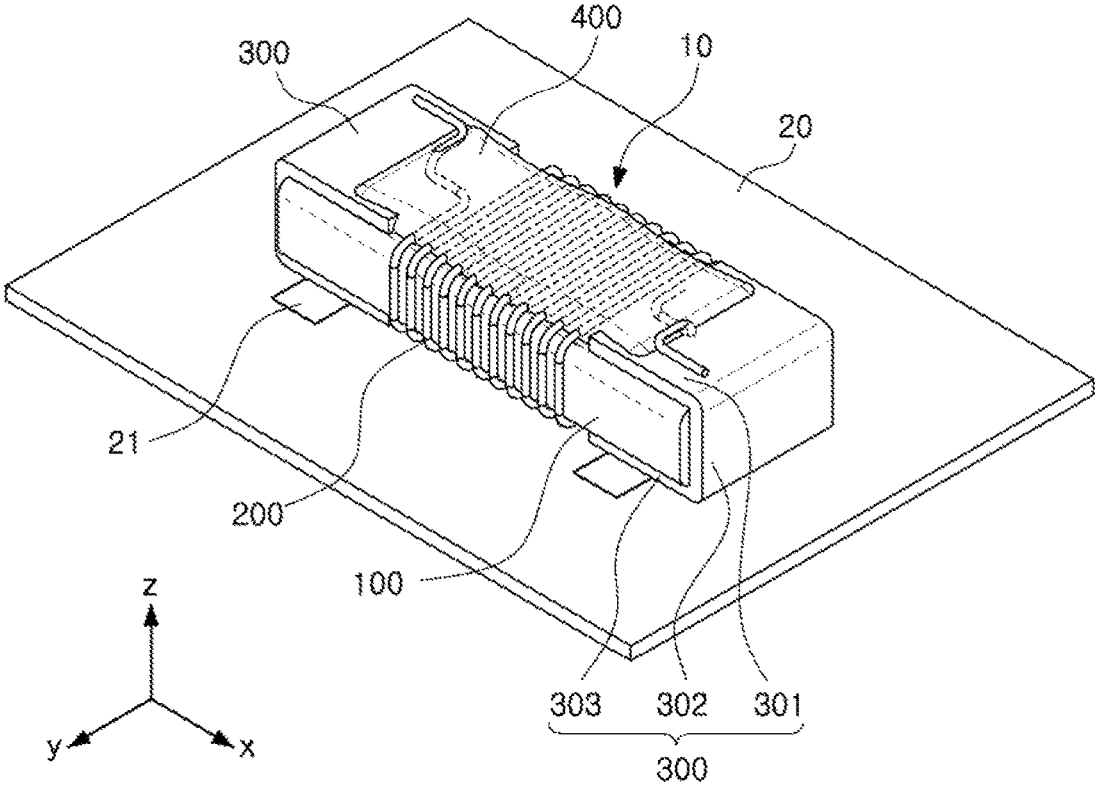
FIG. 7 is a perspective view schematically illustrating another example of a chip antenna according to the present disclosure.

FIG. 7 is a perspective view schematically illustrating another example of a chip antenna according to the present disclosure.

Referring to FIG. 7, in the chip antenna according to the illustrated embodiment, a connection terminal 300 does not have a sleeve shape, but may instead have a "⊏" shape or a "U" shape. In another example, the connection terminal 300 may have a bracket shape that surrounds the end portions of the cord.

The connection terminal 300 includes an upper surface part 301 coupled to the upper surface of the core 100 while contacting the upper surface of the core 100, a lower surface part 303 coupled to the lower surface of the core 100 while contacting the lower surface of the core 100, and a connection part 302 connecting the upper surface part 301 and the lower surface part 303 to each other and disposed at an end portion of the core 100.

In the embodiment described above, the connection terminals 300 are coupled to the core 100 to enclose outer peripheral surfaces of the core 100. Therefore, the end portion of the core 100 may be externally exposed.

However, the connection terminal 300 is coupled to the core 100 to enclose the end portion of the core 100. Therefore, at least a portion or the entirety of the end portion of the core 100 is covered by the connection terminal 300.

As described above, the connection terminal 300 may be variously modified.

As set forth above, in the chip antenna according to an embodiment in the present disclosure, the connection terminal may be separately manufactured and may be then coupled to the core. Therefore, the connection terminal may be more easily manufactured as compared to the related art in which the connection terminal is directly formed on the core.

Although an embodiment in which the connection terminal is generally formed with the same thickness has been described by way of example, the connection terminal is not limited thereto. That is, other portions of the connection terminal may be formed at various thicknesses regardless of the winding thickness of the coil as long as a thickness of a portion of the connection terminal disposed at a lower end of the core may be thicker than the winding thickness of the coil.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna comprising:

a magnetic core:

metal connection terminals disposed on ends of the core and in direct contact with the core; and a coil wound around the core and having ends thereof connected to the connection terminals, wherein at least a portion of the connection terminals has a thickness greater than a winding thickness of the coil.

2. The chip antenna of claim 1, wherein the connection terminals have a sleeve shape enclosing the core.

3. The chip antenna of claim 1, wherein the connection terminals have a disconnected ring shape.

4. The chip antenna of claim 3, wherein end portions of the connection terminals are disposed to face each other.

5. The chip antenna of claim 3, wherein end portions of the connection terminals are respectively disposed on different surfaces of the core.

6. The chip antenna of claim 1, wherein the connection terminals comprise:

an upper surface part contacting an upper surface of the core;

a lower surface part contacting a lower surface of the core; and a connection part extending between the upper surface part and the lower surface part.

7. The chip antenna of claim 6, wherein the connection parts of the connection terminals are each disposed to cover a distal end of the core.

8. The chip antenna of claim 3, wherein the connection terminals comprise metal plates that are elastically deformed and coupled to the core.

9. The chip antenna of claim 1, further comprising a protection resin disposed on at least one surface of the core where the coil is wound around.

10. A method of manufacturing a chip antenna, the method comprising:

preparing a core having a bar shape;

coupling connection terminals to ends of the core by bending the connection terminals directly onto and around the ends of the core, respectively; and winding a coil around the core and connecting the ends of the coil to the connection terminals, wherein a thickness of a portion of the connection terminal disposed below the core is greater than a winding thickness of the coil.

11. The method of claim 10, wherein the coupling of the connection terminals comprises press-fitting the ends of the core into the respective connection terminals.

12. The method of claim 10, further comprising forming a protection resin on at least one surface of the core where the coil is wound around.

13. A method of manufacturing a chip antenna, the method comprising:

coupling a bent conductive plate to a core to form a connection terminal;

electrically connecting a coil wound around the core with the connection terminal to establish an electrical connection; and mounting the core on which the connection terminal is formed on a board, wherein a thickness of a portion of the connection terminal disposed between the core and the board is greater than a winding thickness of the coil.

14. The method of claim 13, wherein the coil is wound in a helical shape around the core, and two connection terminals are disposed on two respective areas of the core to be electrically connected with respective end portions of the coil.

15. The method of claim 13, wherein the coupling of the bent conductive plate comprises press-fitting a distal end of the core into a bent metal plate to form the connection terminal.

* * * * *